US006483480B1

(12) United States Patent
Sievenpiper et al.

(10) Patent No.: US 6,483,480 B1
(45) Date of Patent: Nov. 19, 2002

(54) TUNABLE IMPEDANCE SURFACE

(75) Inventors: Daniel Sievenpiper, Los Angeles; Greg Tangonan, Oxnard; Robert Y. Loo, Agoura Hills; James H. Schaffner, Chatsworth, all of CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 09/589,859

(22) Filed: Jun. 8, 2000

Related U.S. Application Data

(63) Continuation-in-part of application No. 09/537,923, filed on Mar. 29, 2000, and a continuation-in-part of application No. 09/537,922, filed on Mar. 29, 2000.

(51) Int. Cl.[7] ..... H01Q 15/02

(52) U.S. Cl. ..... 343/909; 343/700 MS; 343/754; 343/853

(58) Field of Search ..... 343/700 MS, 754, 343/756, 778, 850, 853, 909, 910; H01Q 15/02

(56) References Cited

U.S. PATENT DOCUMENTS

| | | | | |
|---|---|---|---|---|
| 3,267,480 | A | 8/1966 | Lerner | 343/911 |
| 3,810,183 | A | 5/1974 | Krutsinger et al. | 343/708 |
| 3,961,333 | A | 6/1976 | Purinton | 343/872 |
| 4,150,382 | A | 4/1979 | King | 343/754 |
| 4,266,203 | A | 5/1981 | Saudreau et al. | 333/21 |

(List continued on next page.)

FOREIGN PATENT DOCUMENTS

| | | |
|---|---|---|
| DE | 196 00 609 A1 | 4/1997 |
| WO | WO 98/21734 | 5/1998 |
| WO | WO 99/50929 | 10/1999 |
| WO | WO 00/44012 | 7/2000 |

OTHER PUBLICATIONS

Balanis, C., "Aperture Antennas", *Antenna Theory, Analysis and Design,* 2nd Edition, (New York, John Wiley & Sons, 1997), Chap. 12, pp. 575–597.

Balanis, C., "Microstrip Antennas", *Antenna Theory, Analysis and Design*, 2nd Edition, (New York, John Wiley & Sons, 1997), Chap. 14, pp. 722–736.

Cognard, J., "Alignment of Nematic Liquid Crystals and Their Mixtures" *Mol. Cryst. Liq, Cryst.* Suppl. 1, 1 (1982) pp. 1–74.

Doane, J.W., et al., "Field Controlled Light Scattering from Nematic Microdroplets", *Appl. Phys. Lett.*, vol. 48 (Jan. 1986) pp. 269–271.

Jensen, M.A., et al., "EM Interaction of Handset Antennas and a Human in Personal Communications", *Proceedings of the IEEE*, vol. 83, No. 1 (Jan. 1995) pp. 7–17.

Jensen, M.A., et al., "Performance Analysis of Antennas for Hand–held Transceivers using FDTD", *IEEE Transactions on Antennas and Propagation*, vol. 42, No. 8 (Aug. 1994) pp. 1106–1113.

Ramo, S., et al., *Fields and Waves in Communication Electronics*, 3rd Edition (New York, John Wiley & Sons, 1994) Section 9.8–9.11, pp. 476–487.

Sievenpiper, D., et al., "High-Impedance Electromagnetic Surfaces with a Forbidden Frequency Band", *IEEE Transactions on Microwave Theory and Techniques,* vol. 47, No. 11, (Nov. 1999) pp. 2059-2074.

(List continued on next page.)

*Primary Examiner*—Tho G. Phan
(74) *Attorney, Agent, or Firm*—Ladas & Parry

(57) ABSTRACT

A tuneable impedance surface for steering and/or focusing a radio frequency beam. The tunable surface comprises a ground plane; a first plurality of elements disposed in an array a first distance from the ground plane, the distance being less than a wavelength of the radio frequency beam; and a second plurality of elements disposed in an array a second distance from the ground plane, the second plurality of elements be moveable relative to the first plurality of elements.

26 Claims, 15 Drawing Sheets

U.S. PATENT DOCUMENTS

| | | | | | |
|---|---|---|---|---|---|
| 4,387,377 | A | | 6/1983 | Kandler | 343/756 |
| 4,594,595 | A | | 6/1986 | Struckman | 343/770 |
| 4,749,996 | A | * | 6/1988 | Tresselt | 343/700 MS |
| 4,782,346 | A | | 11/1988 | Sharma | 343/795 |
| 4,843,400 | A | * | 6/1989 | Tsao et al. | 343/700 MS |
| 4,843,403 | A | | 6/1989 | Lalezari et al. | 343/767 |
| 4,853,704 | A | | 8/1989 | Diaz et al. | 343/767 |
| 4,905,014 | A | | 2/1990 | Gonzalez et al. | 343/909 |
| 5,021,795 | A | | 6/1991 | Masiulis | 343/700 |
| 5,023,623 | A | | 6/1991 | Kreinheder et al. | 343/725 |
| 5,081,466 | A | | 1/1992 | Bitter, Jr. | 343/767 |
| 5,115,217 | A | * | 5/1992 | McGrath et al. | 333/246 |
| 5,146,235 | A | | 9/1992 | Frese | 343/895 |
| 5,268,701 | A | | 12/1993 | Smith | 343/767 |
| 5,287,118 | A | | 2/1994 | Budd | 343/909 |
| 5,519,408 | A | | 5/1996 | Schnetzer | 343/767 |
| 5,525,954 | A | | 6/1996 | Komazaki et al. | 333/219 |
| 5,531,018 | A | | 7/1996 | Saia et al. | 29/622 |
| 5,534,877 | A | | 7/1996 | Sorbello et al. | 343/700 |
| 5,541,614 | A | | 7/1996 | Lam et al. | 343/792.5 |
| 5,557,291 | A | | 9/1996 | Chu et al. | 343/725 |
| 5,589,845 | A | | 12/1996 | Yandrofski et al. | 343/909 |
| 5,611,940 | A | | 3/1997 | Zettler | 73/514 |
| 5,638,946 | A | | 6/1997 | Zavracky | 200/181 |
| 5,694,134 | A | * | 12/1997 | Barnes | 343/700 MS |
| 5,721,194 | A | | 2/1998 | Yandrofski et al. | 505/210 |
| 5,874,915 | A | | 2/1999 | Lee et al. | 343/375 |
| 5,894,288 | A | | 4/1999 | Lee et al. | 343/770 |
| 5,923,303 | A | | 7/1999 | Schwengler et al. | 343/853 |
| 5,945,951 | A | | 8/1999 | Monte et al. | 343/700 |
| 5,949,382 | A | | 9/1999 | Quan | 343/767 |
| 6,005,519 | A | * | 12/1999 | Burns | 343/700 MS |
| 6,040,803 | A | * | 3/2000 | Spall | 343/700 MS |
| 6,054,659 | A | | 4/2000 | Lee et al. | 200/181 |
| 6,075,485 | A | | 6/2000 | Lilly et al. | 343/700 |
| 6,081,235 | A | | 6/2000 | Romanofsky et al. | 343/700 |
| 6,097,263 | A | | 8/2000 | Mueller et al. | 333/17.1 |
| 6,097,343 | A | | 8/2000 | Goetz et al. | 343/708 |
| 6,118,406 | A | * | 9/2000 | Josypenko | 343/700 MS |
| 6,127,908 | A | | 10/2000 | Bozler et al. | 333/246 |
| 6,154,176 | A | | 11/2000 | Fathy et al. | 343/700 |
| 6,166,705 | A | * | 12/2000 | Mast et al. | 343/853 |
| 6,175,337 | B1 | | 1/2001 | Jasper, Jr. et al. | 343/770 |
| 6,191,724 | B1 | | 2/2001 | McEwan | 342/21 |
| 6,246,377 | B1 | | 6/2001 | Aiello et al. | 343/770 |

OTHER PUBLICATIONS

Sievenpiper, D., "High–Impedance Electromagnetic Surfaces", Ph.D. Dissertation, Dept. of Electrical Engineering, University of California, Los Angeles, CA, 1999.

Wu, S.T., et al., "High Birefringence and Wide Nematic Range Bis–tolane Liquid Crystals", *Appl. Phys. Lett.* vol. 74, No. 5, (Jan. 1999) pp. 344–346.

Bradley, T.W., et al., "Development of a Voltage–Variable Dielectric (VVD), Electronic Scan Antenna," Radar 97, Publication No. 449, pp. 383–385 (Oct. 1997).

* cited by examiner

E-Field along Y

E-Field along X

TUNABLE IMPEDANCE SURFACE

CROSS REFERENCES TO RELATED APPLICATIONS

This application is a continuation in part of U.S. patent application Ser. No. 09/537,923, filed Mar. 29, 2000 and entitled "A Tunable Impedance Surface", the disclosure of which is hereby incorporated herein by reference. This application is also a continuation in part of U.S. patent application Ser. No. 09/537,922, filed Mar. 29, 2000 and entitled "An Electronically Tunable Reflector", the disclosure of which is also hereby incorporated herein by reference.

The present application is also related to U.S. patent application Ser. No. 09/537,921, filed Mar. 29, 2000 and entitled "An End-Fire Antenna or Array on Surface with Tunable Impedance" the disclosures of which is hereby incorporated herein by reference.

TECHNICAL FIELD

This invention relates to a surface having a tunable electromagnetic impedance which acts as a reconfigurable beam steering reflector.

BACKGROUND OF THE INVENTION

Steerable antennas today are found in two common configurations: those with a single feed or reflector that is mechanically steered using a gimbal, and those with a stationary array of electronically phased radiating elements. Both have shortcomings, and the choice of system used is often a tradeoff between cost, speed, reliability, and RF (radio frequency) performance. Mechanically steered antennas are inexpensive, but moving parts can be slow and unreliable, and they can require an unnecessarily large volume of unobstructed free space for movement. Active phased arrays are faster and more reliable, but they are much more expensive, and can suffer from significant losses due to the complex feed structure required to supply the RF signal to and/or receive the RF signal from each active element of the phased array. Losses can be mitigated if an amplifier is included in each element or subarray, but this solution contributes to noise and power consumption and further increases the cost of the antenna.

One alternative is to use a reflectarray geometry, and replace the lossy corporate feed network with a free space feed. The actively phased elements operate in reflection mode, and are illuminated by a single feed antenna. The array steers the RF beam by forming an effective reflection surface defined by the gradient of the reflection phase across the array. Using current techniques, such a system still requires a large number of expensive phase shifters.

There is a need for a reflective surface, in which the reflection phase could be arbitrarily defined, and easily varied as a function of position. The surface should be less expensive than a comparably sized array of conventional phase shifters, yet hopefully offer similar RF performance. Such a surface could behave as a generic reconfigurable reflector, with the ability to perform a variety of important functions including steering or focusing of one or more RF beams. It is the object of this invention to fulfill this need.

The reconfigurable reflector disclosed herein is based a resonant textured ground plane, often known as the high-impedance surface or simply the Hi-Z surface. This electromagnetic structure has two important RF properties that are applicable to low profile antennas. It suppresses propagating surface currents, which improves the radiation pattern of antennas on finite ground planes and it provides a high-impedance boundary condition, acting as an artificial magnetic conductor, which allows radiating elements to lie in close proximity to the ground plane without being shorted out. It has origins in other well-known electromagnetic structures such as the corrugated surface and the photonic band gap surface. A prior art high-impedance surface is disclosed in a pending US patent application of D. Sievenpiper, E. Yablonovitch, "Circuit and Method for Eliminating Surface Currents on Metals", U.S. provisional patent application Ser. No. 60/079,953, filed on Mar. 30, 1998.

A prior art high-impedance surface is shown in FIG. 1. It consists of an array of metal top plates or elements 10 on a flat metal sheet 12. It can be fabricated using printed circuit board technology with the metal plates or elements 10 formed on a top or first surface of a printed circuit board and a solid conducting ground or back plane 12 formed on a bottom or second surface of the printed circuit board. Vertical connections are formed as metal plated vias 14 in the printed circuit board, which connect the elements 10 with the underlying ground plane 12. The metal members, comprising the top plates 10 and the vias 14, are arranged in a two-dimensional lattice of cells or cavities, and can be visualized as mushroom-shaped or thumbtack-shaped members protruding from the flat metal surface 12. The thickness of the structure, which is controlled by the thickness of the printed circuit board, is much less than one wavelength for the frequencies of interest. The sizes of the elements 10 are also kept less than one wavelength for the frequencies of interest. The printed circuit board is not shown for ease of illustration.

Turning to FIG. 2, the properties of this surface can be explained using an effective circuit model or cavity which is assigned a surface impedance equal to that of a parallel resonant LC circuit. The use of lumped cavities to describe electromagnetic structures is valid when the wavelength is much longer than the size of the individual features, as is the case here. When an electromagnetic wave interacts with the surface of FIG. 1, it causes charges to build up on the ends of the top metal plates 10. This process can be described as governed by an effective capacitance C. As the charges slosh back and forth, in response to a radio-frequency field, they flow around a long path P through the vias 14 and the bottom metal surface 12. Associated with these currents is a magnetic field, and thus an inductance L. The capacitance C is controlled by the proximity of the adjacent metal plates 10 while the inductance L is controlled by the thickness of the structure.

The structure is inductive below the resonance and capacitive above resonance. Near its resonance frequency, $$\omega = \frac{1}{\sqrt{LC}},$$

the structure exhibits high electromagnetic surface impedance. The tangential electric field at the surface is finite, while the tangential magnetic field is zero. Thus, electromagnetic waves are reflected without the phase reversal that occurs on a flat metal sheet. In general, the reflection phase can be 0, $\pi$, or anything in between, depending on the relationship between the test frequency and the resonance frequency of the structure. The reflection phase as a function of frequency, calculated using the effective medium model, is shown in FIG. 3. Far below resonance, it behaves like an ordinary metal surface, and reflects with a π phase shift. Near resonance, where the surface impedance is high, the reflection phase crosses through zero. At higher frequencies, the phase approaches −π. The calculated model of FIG. 3 is supported by the measured reflection phase, shown for an example structure in FIG. 4.

A large number of structures of the type shown in FIG. 1 have been fabricated with a wide range of resonance frequencies, including various geometries and substrate materials. Some of the structures were designed with overlapping capacitor plates, to increase the capacitance and lower the frequency. The measured and calculated resonance frequencies for twenty three structures with various capacitance values are compared in FIG. 5. Clearly, the resonance frequency is a predictable function of the capacitance. The dotted line in FIG. 5 has a slope of unity, and indicates perfect agreement. The bars indicate the instantaneous bandwidth of the surface, defined by the frequencies where the phase is between π/2 and −π2.

For a more detailed description and analysis of the high-impedance surface, see D. Sievenpiper, L. Zhang, R. Broas, N. Alexopolous, E. Yablonovitch, "High-Impedance Electromagnetic Surfaces with a Forbidden Frequency Band", IEEE Transactions on Microwave Theory and Techniques, vol. 47, pp. 2059–2074, 1999 and D. Sievenpiper, "High-Impedance Electromagnetic Surfaces", Ph.D. dissertation, Department of Electrical Engineering, University of California, Los Angeles, Calif., 1999.

When the resonant cavities are much smaller than the wavelength of interest, the electromagnetic analysis can be simplified by considering them as lumped LC circuits. The proximity of the neighboring metal plates provides capacitance, while the conductive path that connects them provides inductance. The textured ground plane supports an electromagnetic boundary condition that can be characterized by the impedance of an effective parallel LC circuit, given by $$Z_s = \frac{j\omega L}{1-\omega^2 LC},$$

The sheet inductance is L=$\mu$t, where $\mu$ is the magnetic permeability of the circuit board material, and t is its thickness. For a structure with parallel plate capacitors arranged on a square lattice, the sheet capacitance is C=∈A/d, where e is the electric permitivity of the dielectric insulator, and A and d are the overlap area and separation, respectively, of the metal plates.

The surface has a frequency-dependent reflection phase given by $$\Phi = \mathrm{Im}\left\{\mathrm{Ln}\left(\frac{Z_s-\eta}{Z_s+\eta}\right)\right\}$$

where η is the impedance of free space. Far from the resonance frequency, the surface behaves as an ordinary electric conductor, and reflects with a π phase shift.

Near the resonance frequency, the cavities interact strongly with the incoming waves. The surface supports a finite tangential electric field across the lattice of capacitors, and the structure has high, yet reactive surface impedance. At resonance, it reflects with zero phase shift, providing the effective boundary condition of an artificial magnetic conductor. Scanning through the resonance condition from low to high frequencies, the reflection phase varies from π, to zero, to −π. Thus, by tuning the resonance frequency of the cavities, one can tune the reflection phase of the surface for a fixed frequency.

This tunable reflection phase is the basis of the reconfigurable beam steering reflector disclosed herein. By varying the reflection phase as a function of position across the surface, one can perform a variety of functions. For example, a linear phase gradient is equivalent to a virtual tilt of the reflector. A saw-tooth phase function transforms the surface into a virtual grating. A parabolic phase function can focus a plane wave onto a small feed horn, allowing the flat surface to replace a parabolic dish.

BRIEF DESCRIPTION OF THE INVENTION

Features of the present invention include:

1. A device with tunable surface impedance;
2. A method for focusing an electromagnetic wave using the tunable surface; and
3 . A method for steering an electromagnetic wave using the tunable surface.

This invention provides a reconfigurable electromagnetic surface which is capable of performing a variety of functions, such as focusing or steering a beam. It improves upon the high-impedance surface, which is the subject of U.S. Provisional Patent Serial No. 60/079,953, to include the important aspect of tunability.

The present invention provides, in one aspect, a tuneable impedance surface for steering and/or focusing a radio frequency beam, the tunable surface comprising: a ground plane; a first plurality of top plates disposed a distance from the ground plane, the distance being less than a wavelength of the radio frequency beam; and a second plurality of top plates disposed a different distance from the ground plane, the second plurality being moveable relative to the first plurality.

DETAILED DESCRIPTION

The Tunable Impedance Surface

Figure 1:
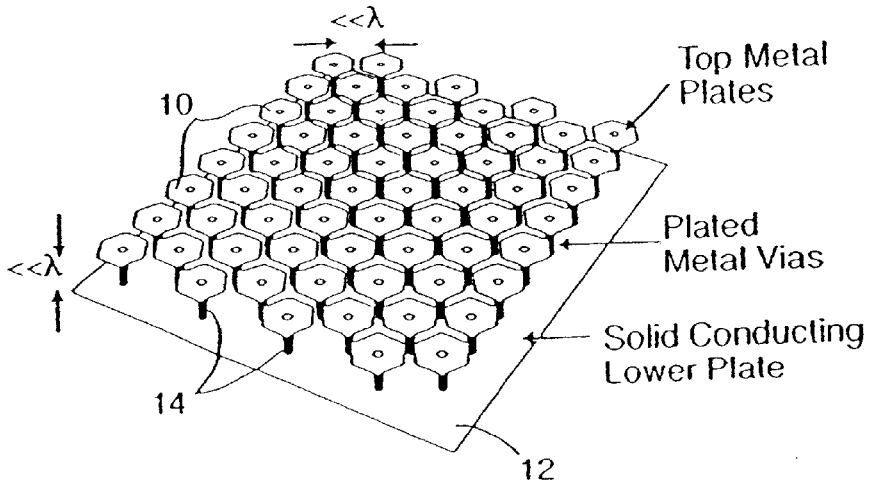
Figure 1 (PRIOR ART)
FIG. 1 depicts a conventional high-impedance surface fabricated using printed circuit board technology of the type disclosed in U.S. Provisional Patent Serial No. 60/079,953 and having metal plates on the top side connect through metal plated vias to a solid metal ground plan on the bottom side.
Figure 2:
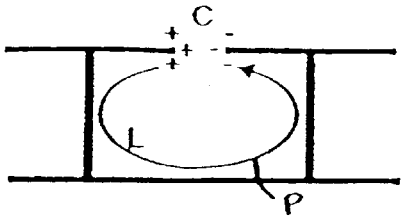
Figure 2 (PRIOR ART)
FIG. 2 is a circuit equivalent of a pair of adjacent metal top plates and associated vias.
Figure 3:
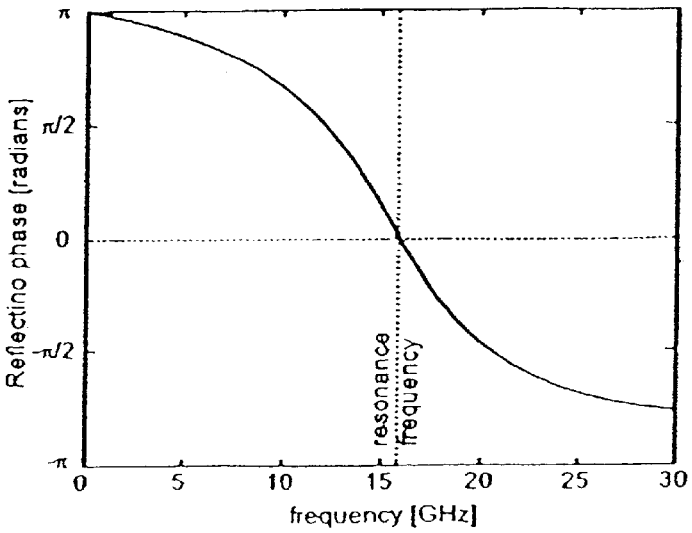
Figure 3 (PRIOR ART)
FIG. 3 depicts the calculated reflection phase of the high-impedance surface, obtained from the effective medium model and shows that the phase crosses through zero at the resonance frequency of the structure.
Figure 4:
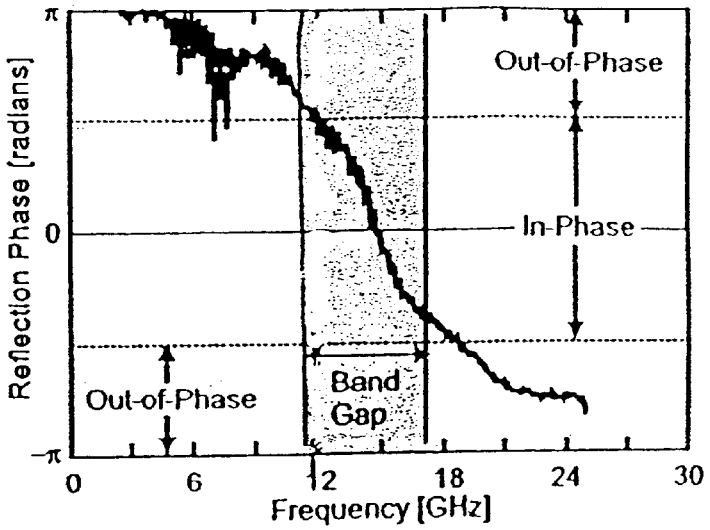
Figure 4 (PRIOR ART)
FIG. 4 shows that the measured reflection phase agrees well with the calculated reflection phase.
Figure 5:
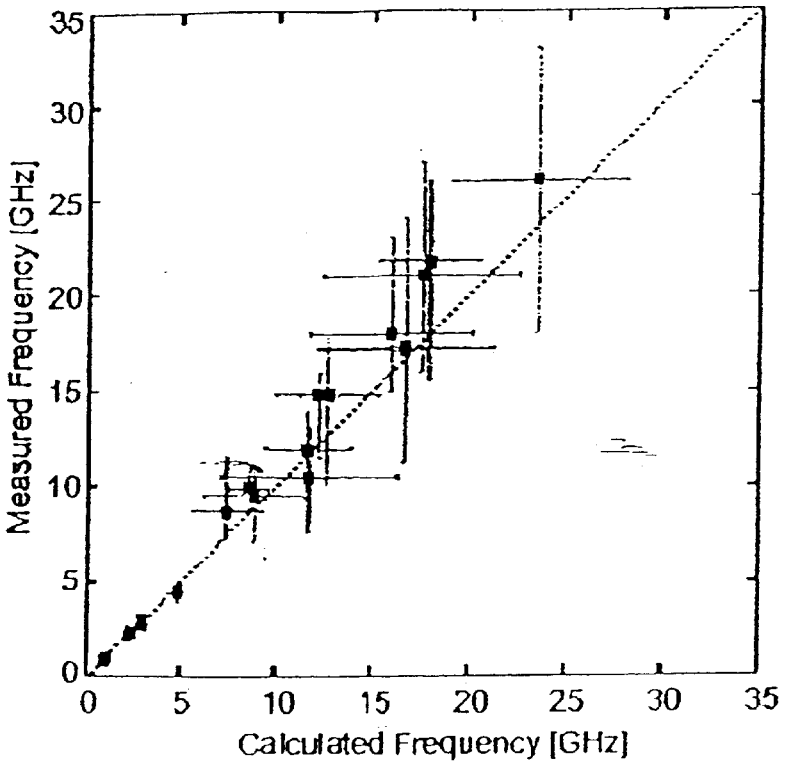
Figure 5 (PRIOR ART)
FIG. 5 depicts the measured resonance frequency compared to the calculated resonance frequency, using the effective circuit model of FIG. 2, for twenty three examples of the surface shown in FIG. 1.
Figure 6B:
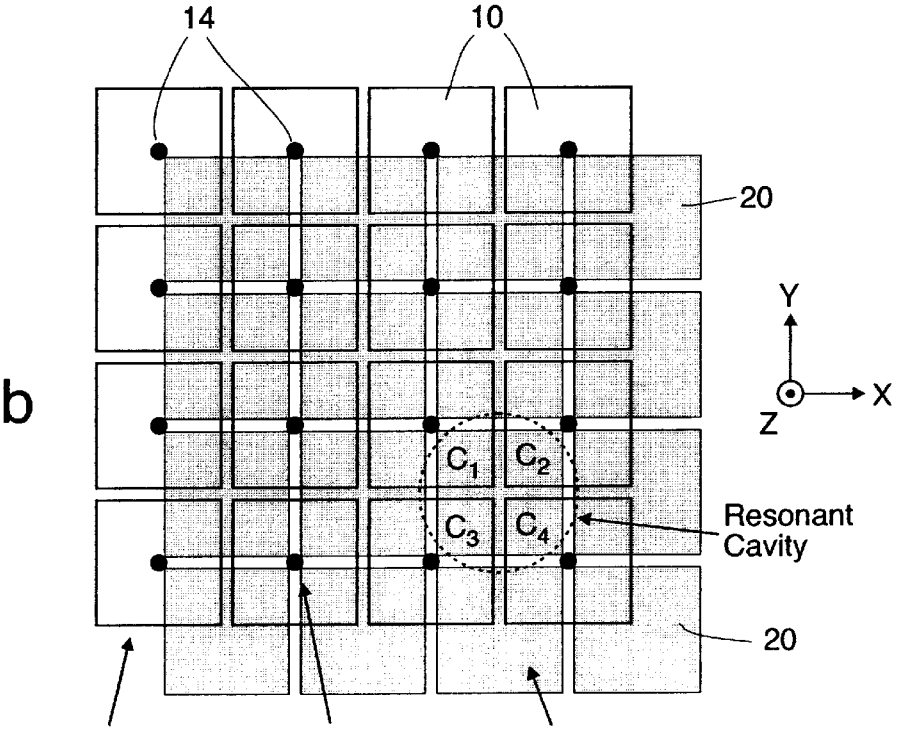
FIGS. 6(*a*) and 6(*b*) depict a pair of printed circuit boards, in side elevation and plan views, one board of which is a high-impedance surface while the second board is slidable relative to the high-impedance surface and includes an array of conductive plates or patches which overlap the plates or patches of the high-impedance surface.
Figure 6A:
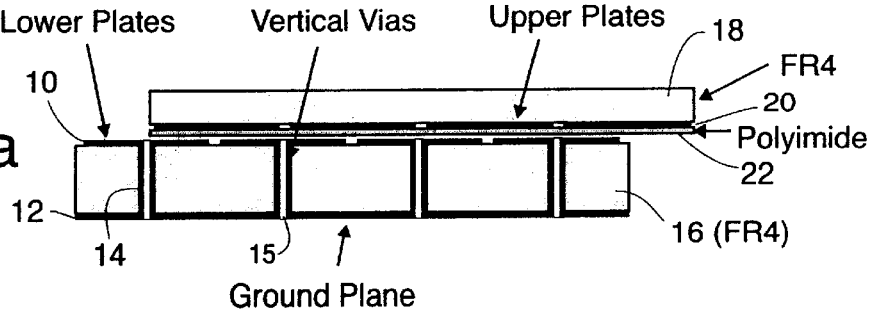

FIGS. 6(*a*) and 6(*b*) depict a tunable impedance surface in accordance with the present invention. FIG. 6(*b*) is a plan view thereof while FIG. 6(*a*) provides a side elevation view thereof. The tunable impedance surface includes a pair of printed circuit boards 16, 18. The first board 16 has a lattice of conductive structures 10, 14 resembling the conventional high-impedance surface previously described. The back of this first board has a ground plane 12, preferably made of a thin, but solid, metal, and the front is covered with an array of conductive plates or patches 10 preferably made of metal, which are connected to the ground plane by conductive vias 14 preferably formed by plated metal. The conductive patches 10 and their associated conductive vias 14 form the conductive thumbtack-like structures. This structure can be easily fabricated, for example, on FR4, a standard fiberglass-based printed circuit material.

The second board 18 includes an array of conductive tuning plates or patches 20, preferably made of metal, which are designed to overlap the conductive patches 10 on the first board 16. The tuning patches 20 are supported on a sheet of FR4, and are preferably covered by an insulating layer 22 such as Kapton polyirnide. The two boards may be pressed together with the conductive plates or patches 10, 20 separated by the polyimide insulator, forming a lattice of parallel plate capacitors. The confronting surfaces are designed to slide against each other, to allow adjustment of the overlap area between the matching sets of metal plates 10, 20, and thus allow the capacitors to be tuned. Indeed the confronting surfaces are preferably brought into close contact with each other as is even better depicted in FIG. 8.

The two boards 16, 18 typically have a large number of conductive plates or patches 10, 20 formed thereon and the figures only show a small number of the plates or patches which would typically be formed for clarity of representation. In the experimental structure, which is discussed below, each board has approximately 1600 patches disposed thereon. The number of patches utilized is a matter of design choice.

An Experimental Structure

An experimental structure has been made and tested. In the experimental structure, the plates 10, 20 were provided by square metal patches 10, 20 formed on both boards 16, 18 which measured 6.10 mm on each side and they were distributed on a 6.35 mm lattice. The fixed board 16 was 6.35 mm thick, and the conducting vias 14 were 500 $\mu$m in diameter, centered on the square metal plates 10. The movable board 18 was 1.57 mm thick, and the polyimide insulator 22 that covered the tuning plate was 50 $\mu$m thick. Both boards measured 25.4 cm on each edge. As such each board had an array of approximately 40 by 40 conducive patches 10, 20 thereon. To ensure uniform, intimate contact between the two matching surfaces, a vacuum pump was attached to the back of the fixed board. This evacuated the space between the boards by way of the hollow openings 15 preferably provided in the vias 14 and forced the two together.

Figure 7:
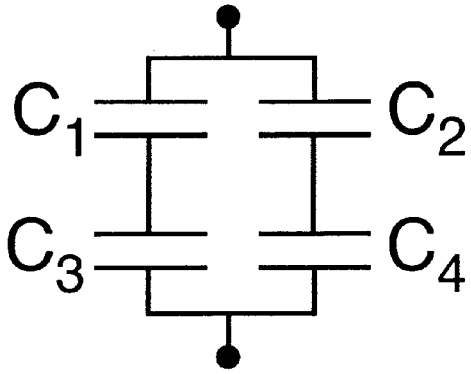
FIG. 7 depicts a circuit topology corresponding to FIGS. 6(*a*) and 6(*b*) showing how the change in capacitance depends on the polarization of an incoming wave.
Figure 7:
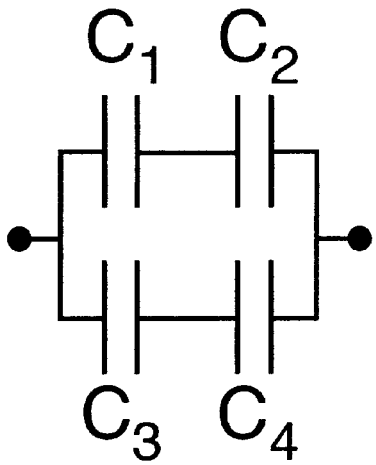

By sliding the upper board 18 relative to the lower board 16, the overlap area of the capacitors is changed, tuning the resonance frequency of the small cavities on the surface. However, only movement that is parallel to the applied electric field contributes to a change in resonance frequency. This can be understood from the following discussion: The resonance frequency of the cavities is given by $$\omega = \frac{1}{\sqrt{LC}},$$

where C is the effective capacitance produced by a combination of four separate capacitors $C_1$–$C_4$ indicated in FIG. 6(*b*). The mode that is excited in the cavities, and the circuit topology that produces the effective capacitance, depends on the polarization of the incoming wave. The circuit topology for two cases is shown in FIG. 7.

Figure 8:
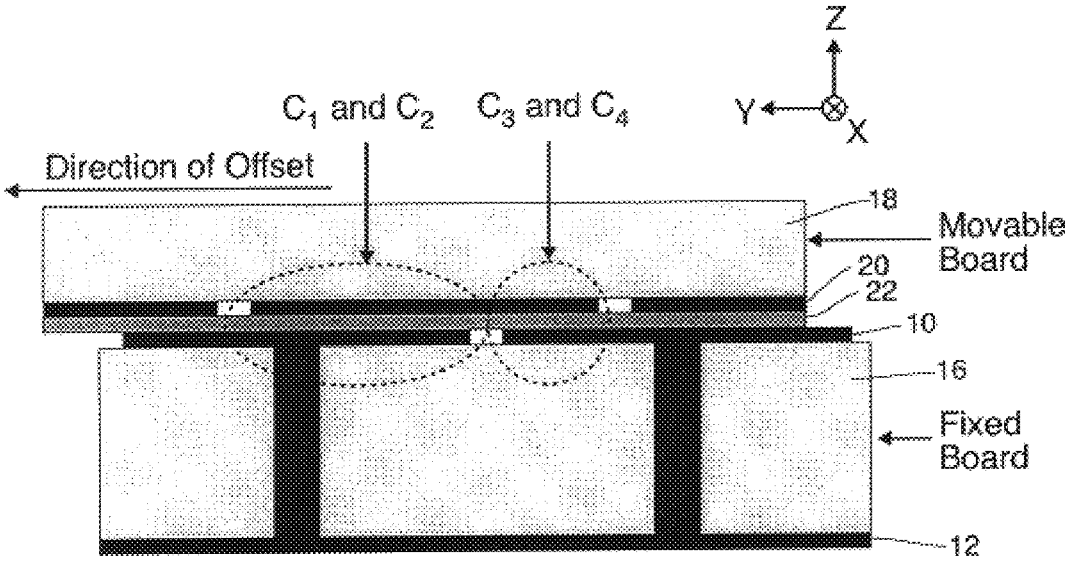
FIG. 8 is a somewhat more detailed version of FIG. 6(*a*), showing the two boards contacting each other and showing the effect of movement of one board relative to the other in terms of capacitance changes.

For example, consider an incoming wave polarized along direction Y, referring to FIG. 6(*b*) for orientation. The effective capacitance is $(C_1+C_2)$ in series with $(C_3+C_4)$. If the top board 18 is moved in the +Y direction, parallel to the applied field, then $C_1$ and $C_2$ are increased while $C_3$ and $C_4$ are decreased by the same amount, as shown in FIG. 8. Since the motion occurs along the direction of pairs of capacitors that are in series, the result is a net change in capacitance, and thus a change in resonance frequency. Conversely, if the top plate 18 is moved in the +X direction, perpendicular to the applied field, then $C_2$ and $C_4$ are increased while $C_1$ and $C_3$ are decreased by the same amount. Since the motion occurs along the direction of pairs that are in parallel, there is no net change in capacitance, and no change in resonance frequency. The maximum effective capacitance, and thus the lowest resonance frequency, occurs when the upper plate is centered such that capacitors that are in series have equal value. Those skilled in the art will appreciate that this justification, of why the square shapes work when one set is rotated with respect to the other set, does not limit the invention to square shaped top plates 18 and square shaped lower plates 14. These same sort of effect is obtained if (i)

non-square shapes are used, (ii) non-uniform shapes are used with relative translation movement and (iii) shapes based on a polar coordinate system (like segmented rings of metal plates) are used with rotational movement.

The resonance frequency of the high impedance surface defines the frequency where the reflection phase crosses through zero. For a fixed test frequency, a change in the resonance frequency of the surface appears as a change in reflection phase. To measure the reflection phase of the experimental structure, a network analyzer was used and a pair of horn antennas, one for transmitting and the other for receiving, were also used. The horns were placed next to each other, both aimed at the tunable surface, and separated by a sheet of microwave absorber. Microwave energy was transmitted from one horn, reflected by the surface, and received with the other horn, while the reflection phase was monitored for various positions of the movable board. The use of separate transmitting and receiving horns was used for this experiment because it eliminates interference from internal reflections within the antennas. The data was compared to a reference scan taken using a flat metal surface, which is known to have a reflection phase of $\pi$.

Figure 9:
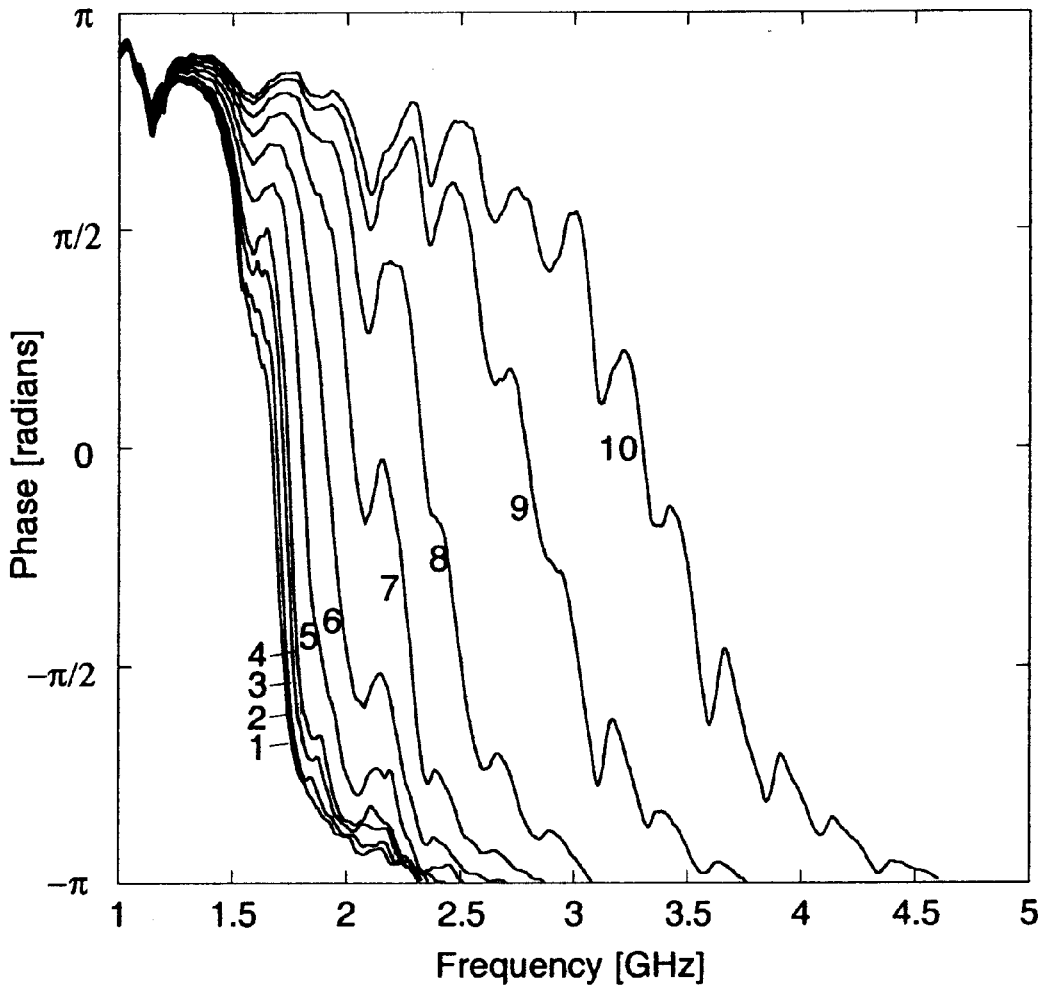
FIG. 9 is a graph of the measured reflection phase of the experimental structure shown in FIGS. 6(*a*) and (*b*) as a function of frequency for ten different positions of the one board, displaced in the direction of the applied electric field relative to the other board.

The reflection phase of the experimental structure is shown in FIG. 9 as a function of frequency for ten different positions of the upper board, displaced in the direction of the applied electric field. By varying the overlap area of the capacitor plates, the resonance frequency is tuned from roughly 1.7 GHz to 3.3 GHz. The series of scans shown corresponds to a total translation of one-half period of the textured surface, or 3.2 mm. The tuning range is limited by the maximum and minimum achievable capacitance, which depend on the area of the plates, the thickness of the insulator, and the fringing field in the surrounding medium.

Reflective Beam Steering

Figure 10:
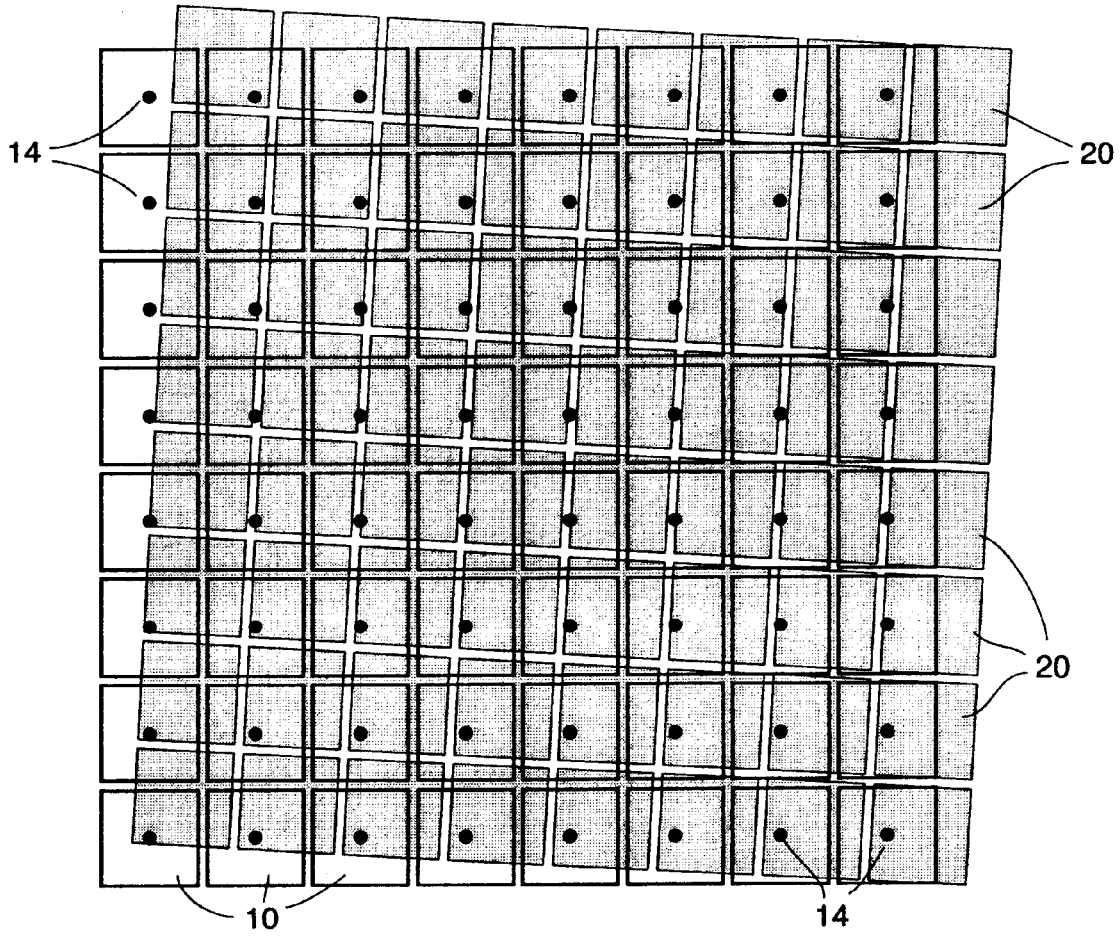
FIG. 10 shows rotation of one board relative to the other in order to vary the resonance frequency and thus the reflection phase, as a function of position, of the tunable surface so that it can be used to steer a reflected beam.

By varying the resonance frequency, and thus the reflection phase, as a function of position, the tunable surface can be used to steer a reflected beam. The simplest approach to beam steering is to create a monotonic, preferably linear phase gradient across the surface. For a mechanically tuned reflector, this can be accomplished by a rotation of one printed circuit board with respect to the other one, as shown in FIG. 10. From the discussion set forth above, the reflection phase is only affected by translation of the capacitor plates in the direction parallel to the applied electric field. For a wave polarized along Y, only the component of translation in the Y direction is relevant, and the translation along X has no effect. For each individual capacitor plate, a small rotation of one board relative to the other produces a translation in Y that is roughly a linear function of X, but is largely independent of Y. Thus, rotation generates a monotonic phase gradient in the direction perpendicular to the applied electric field, which is equivalent to a virtual tilt of the surface. Only a small mechanical motion is required, since the maximum displacement needed at the edge of the board is only one-half of the lattice period.

To measure the beam steering properties of a tunable reflector afforded by the previously discussed experimental structure, the experimental structure was mounted vertically on a rotating pedestal and the reflection magnitude was measured as a function of incidence angle using two stationary horn antennas. Adjustment screws placed at two corners of the surface allowed independent control of both the relative orientation and the relative vertical displacement of the two boards. Repeated measurements of the reflection pattern were taken for various positions of the movable board. The measurements described below were performed at 3.1 GHz.

Figure 11:
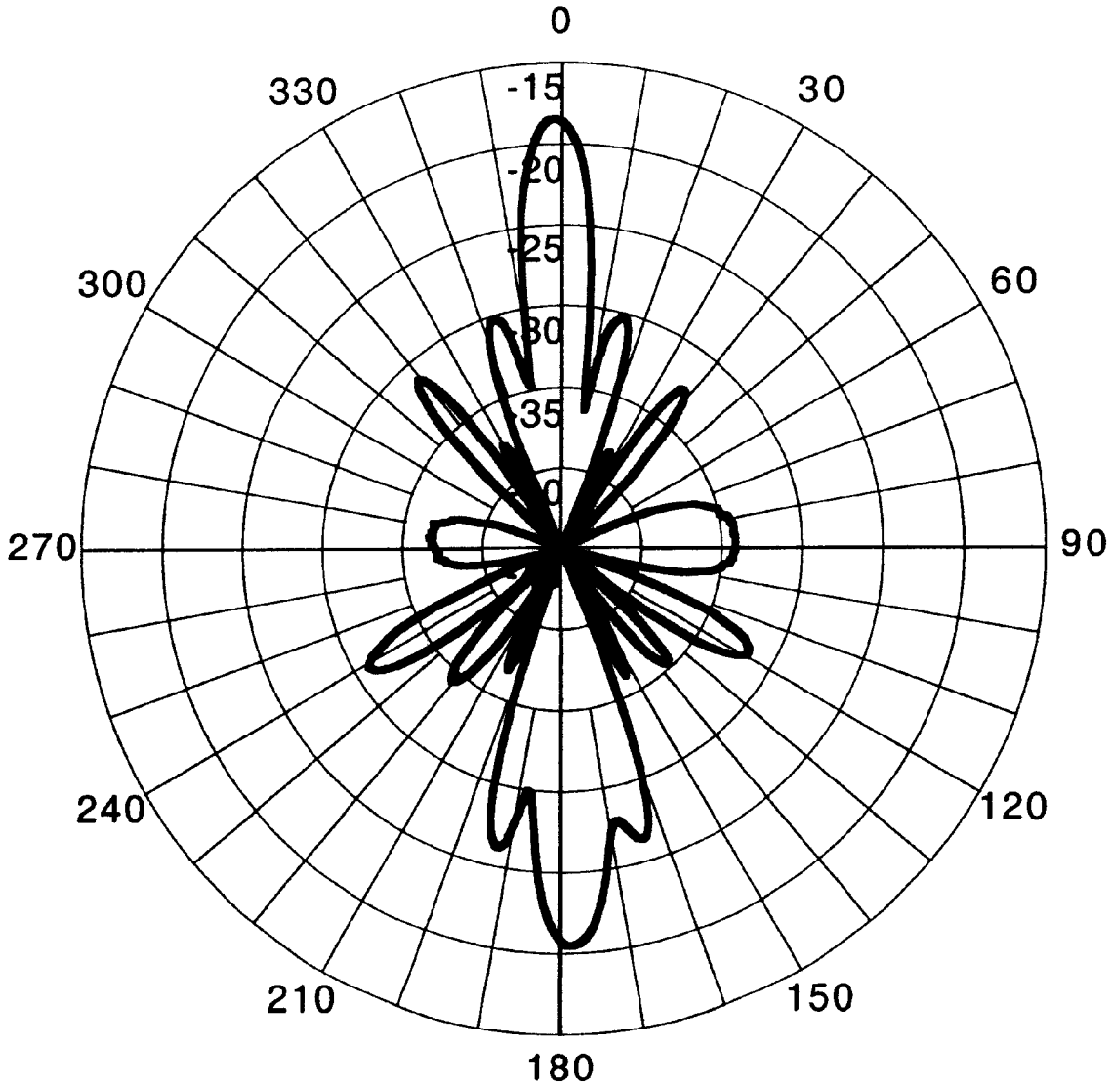
FIG. 11 is a graph of the measured reflection magnitude as a function of incidence angle with the two boards aligned with each other.

With the plates 10, 20 of two boards 16, 18 of the experimental structure aligned with each other, the surface has no phase gradient, and the angle of reflection is equal to the angle of incidence. The reflection magnitude as a function of incidence angle is shown in FIG. 11. As expected from the foregoing discussion, the reflection is strongest at 0 and 180 degrees when the front and back surfaces of the reflector are directly facing the horns. The lobes at other angles are due to reflections from the rotating stage, the edges of the boards, the adjustment screws, the walls of our anechoic chamber, and other objects. The asymmetry in the reflection magnitude and angular profile between the front and back sides of the pattern is due to an acrylic vacuum plate which was attached to the back of the reflector to hold the two printed circuit boards making up the experimental structure together. The difference in reflection phase between the two surfaces also contributes to this asymmetry, because it affects the way the reflected waves interfere with other reflections from the surroundings.

Figure 12A:
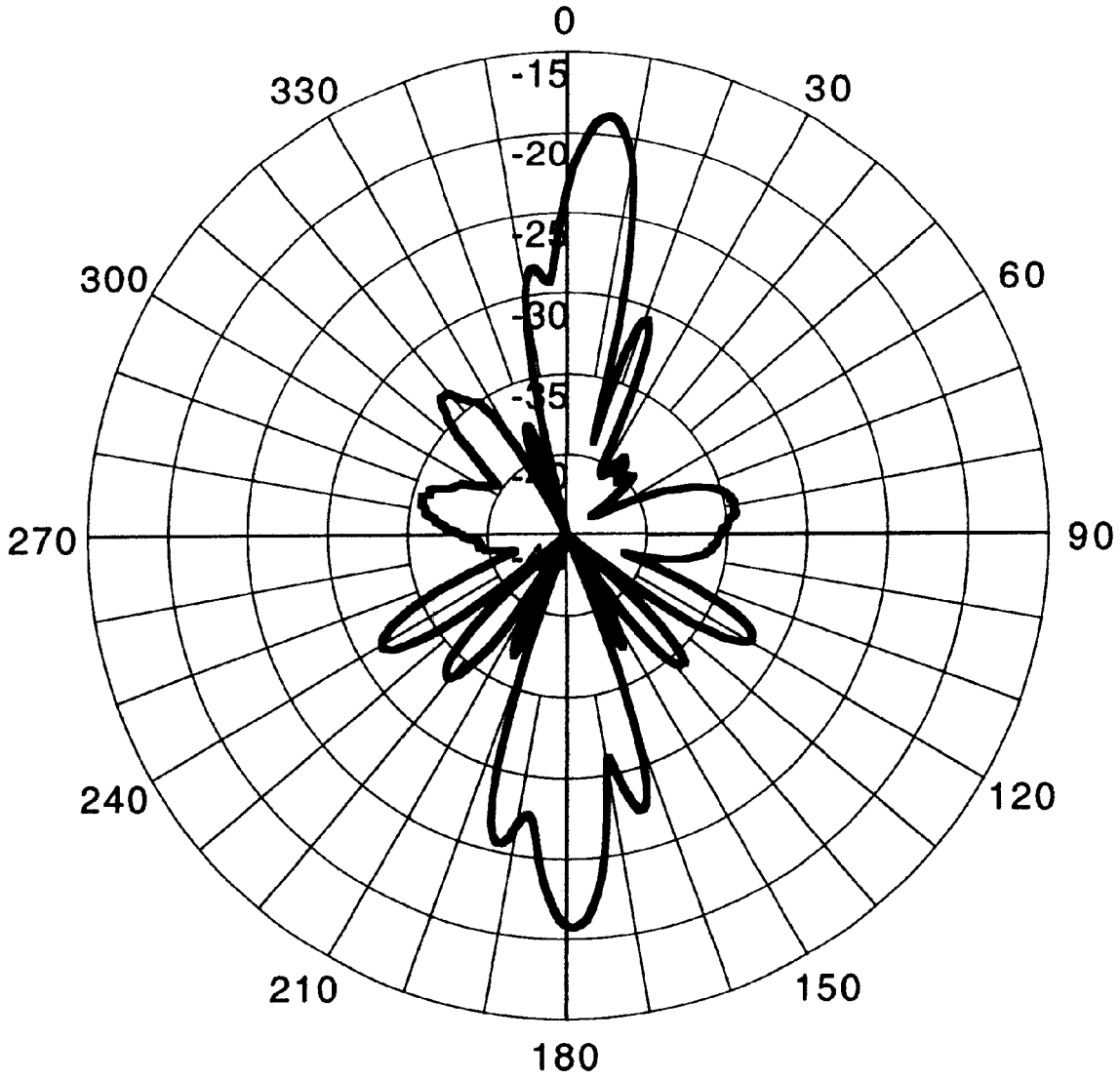
FIGS. 12(*a*) and 12(*b*) are graphs of the measured reflection magnitude as a function of incidence angle with for two different relative orientations of the two boards.
Figure 12B:
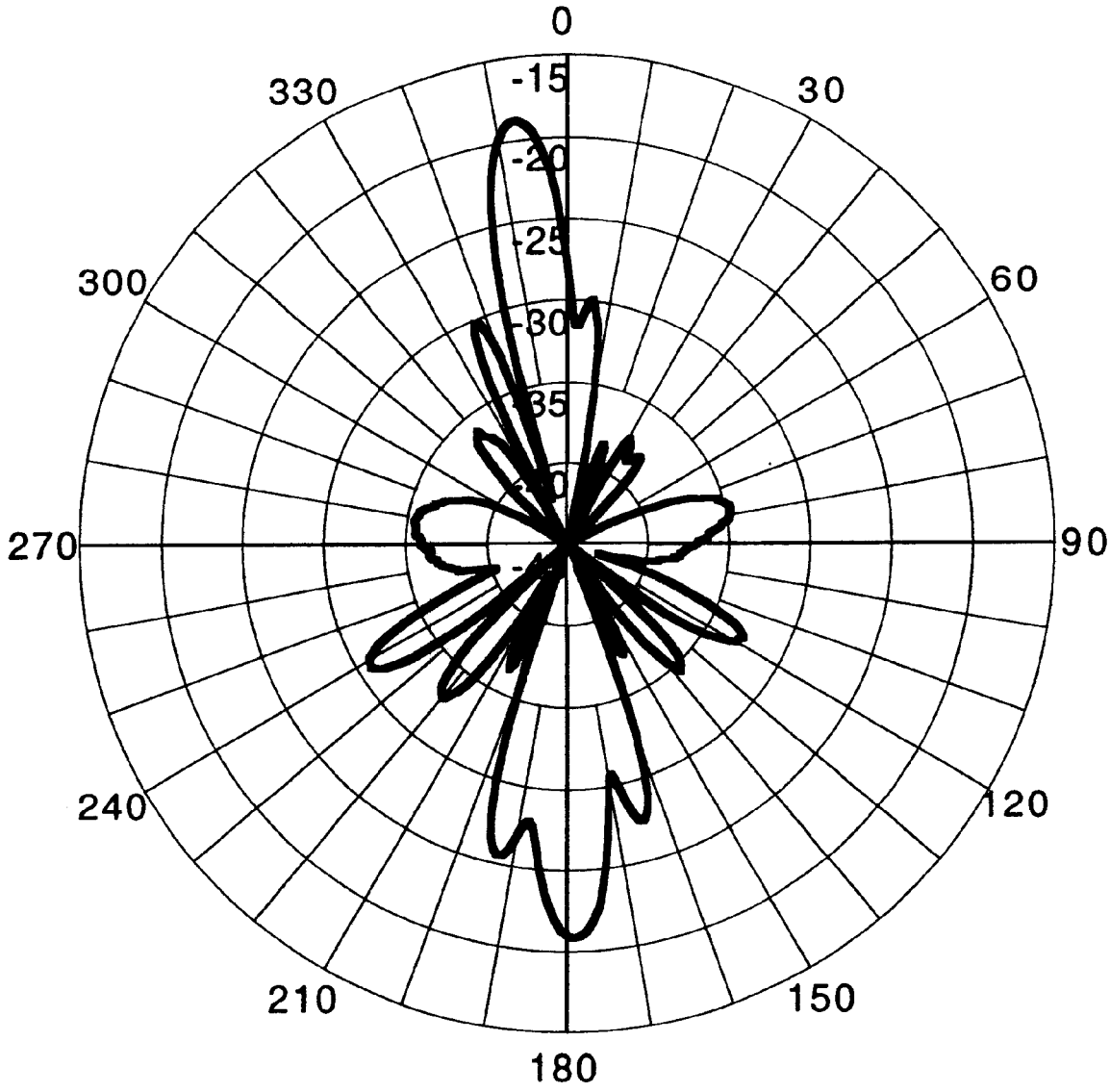

When one board of the experimental structure is rotated against the other, the resulting phase gradient causes a normally incident wave to be reflected at an angle given by $$\theta = 2\tan^{-1}\left(\frac{\lambda g}{2\pi}\right),$$

where g is the phase gradient in radians per meter and $\lambda$ is the wavelength. The reflection patterns for two different relative orientations of the plates 10, 20 of the two boards 16,18 are shown in FIGS. 12(*a*) and 12(*b*). FIGS. 12(*a*) and 12 (*b*) are graphs of the measured reflection magnitude as a function of incidence angle with for two different relative orientations of the two boards. In FIG. 12(*a*) the graph is for the orientation shown by FIG. 10, while FIG. 12(*b*) is for rotation of the upper board 18 in a direction opposite to that shown by FIG. 10. The main lobes can be seen at angles of about +/−8 degrees, indicating that the surface no longer reflects in the specular direction, but rather in a direction determined by magnitude and direction of the phase gradient. By rotating the upper surface between these extremes, the reflection angle can be tuned in an analog fashion. Of course, the lobe in the backward direction still appears at 180 degrees, because the back of the surface is untextured. It should be noted that because the transmitting and receiving horns are stationary and mounted next to each other, the main lobes of the reflection pattern indicate angles at which a plane wave is reflected directly back towards its source. This means that a normally incident plane wave would be reflected to twice the angle measured in this experiment, and could be steered over a range of +/−16 degrees.

Because the resonance frequency is not a linear function of the displacement, as seen from FIG. 9, the maximum useful range of motion is actually less than one-half period. For the results described above, the difference in displacement between the two edges of the structure was roughly 1 mm, or 0.01 wavelength. The higher-frequency region is preferred between 2.5 GHz and 3.3 GHz, where the resonance frequency is roughly a linear function of displacement. This region also defines the bandwidth over which the surface can effectively steer a beam.

Microwave Grating

Using a monotonic phase function, the maximum reflection angle is achieved when the phase varies by $2\pi$ across the width of the surface. This limits the beam steering capabilities of a surface with a width w to $$\theta = 2\tan^{-1}\left(\frac{w}{\lambda}\right).$$

In order to steer to larger angles, a larger phase gradient must be used. Since phase can only be defined modulo $2\pi$, periodic discontinuities of $2\pi$ must be included in the phase function. Such a surface can effectively be considered a grating. Generally speaking, gratings are physical structures. In this embodiment the present invention mimics a grating.

Figure 13:
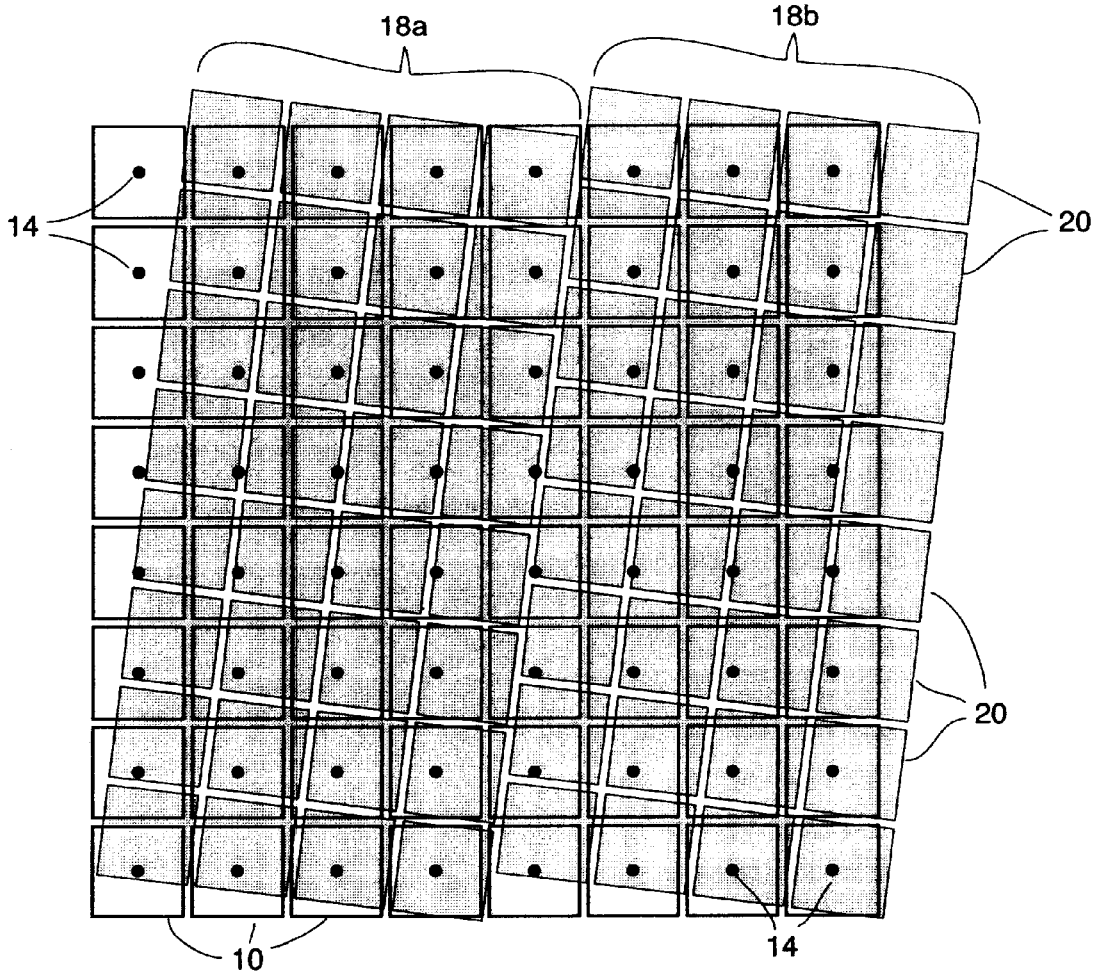
FIG. 13 demonstrates a test of the microwave grating having two periods in which the movable board of the experimental structure was physically divided down its center into two portions were offset as shown in this figure.
Figure 14A:
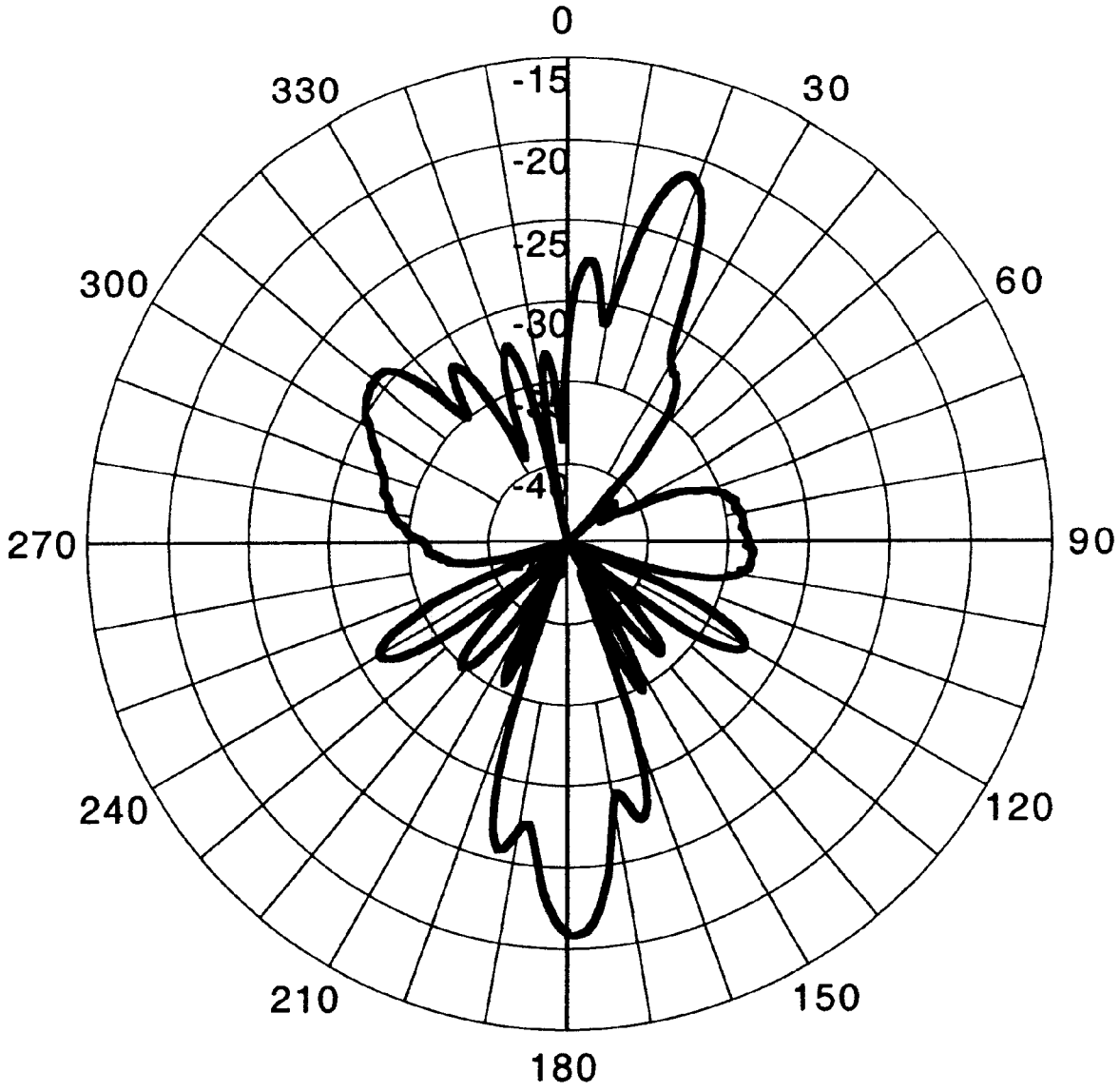
FIGS. 14(*a*) and 14(*b*) are graphs of the measured reflection magnitude as a function of incidence angle with for two different relative orientations of the two boards when set up to have two periods as shown in FIG. 13.
Figure 14B:
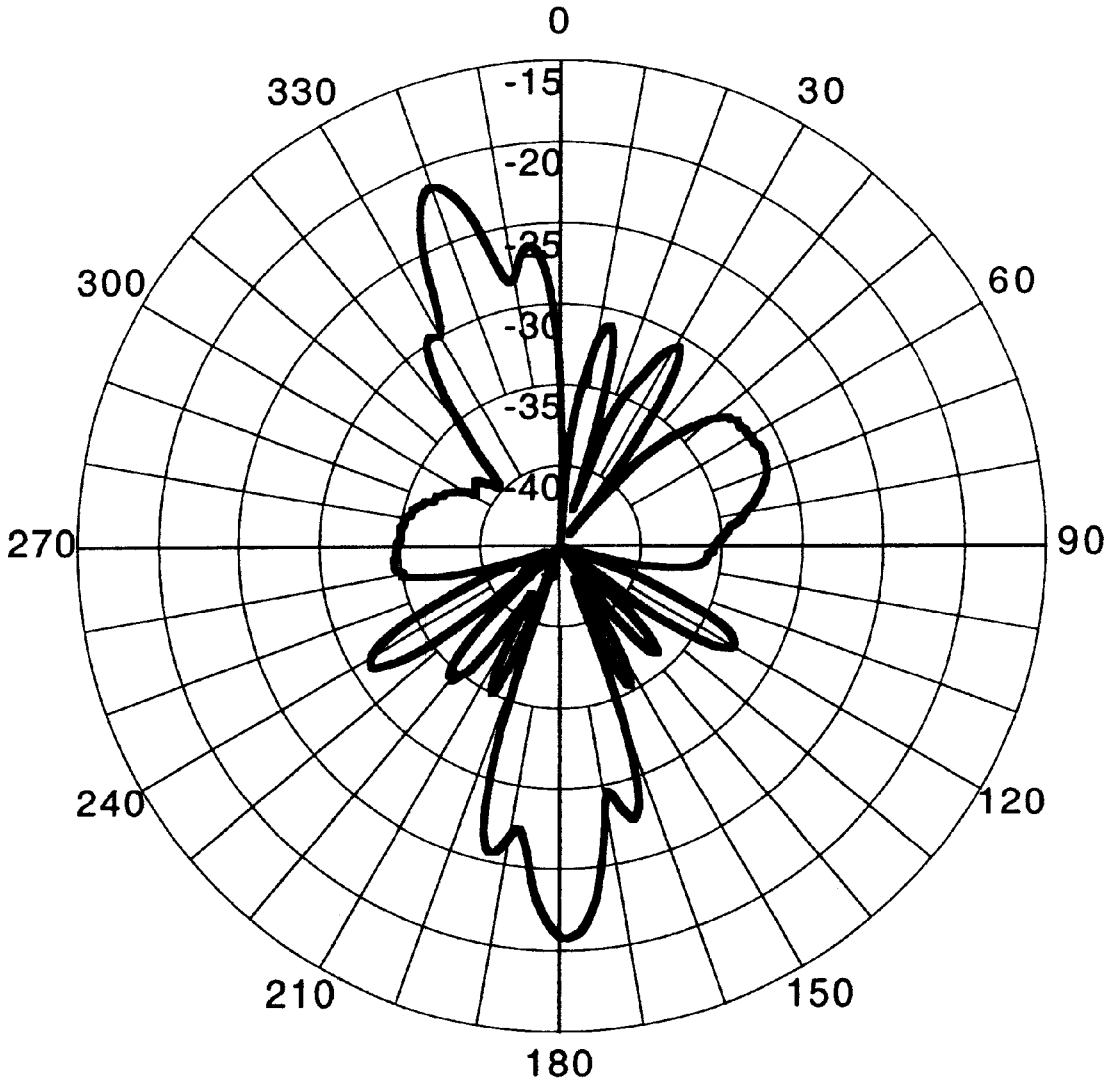

In order to test a microwave grating with two periods using the experimental structure, the movable board 18 was physically divided down its center into two portions 18*a* and 18*b*, and the two portions were offset as shown in FIG. 13. This provided the phase discontinuity used to produce a two-period grating, which has twice the phase gradient as the monotonic surface previously described. FIGS. 14(*a*) and 14 (*b*) are graphs of the measured reflection magnitude as a function of incidence angle with for two different relative orientations of the two boards when set up to have two periods as shown in FIG. 13. In FIG. 14(*a*) the graph is for the orientation shown by FIG. 13, while FIG. 14(*b*) is for rotation of the upper board 18 in a direction opposite to that shown by FIG. 13. The maximum reflection angle now occurs at +/−19 degrees. For a normally incident plane wave this corresponds to beam steering of +/−38 degrees. As before, the beam could be steered to any angle within this range by adjusting the phase gradient, while maintaining the $2\pi$ phase discontinuity. For larger angles, or for larger surfaces, multiple discontinuities can of course be used.

Figure 15:
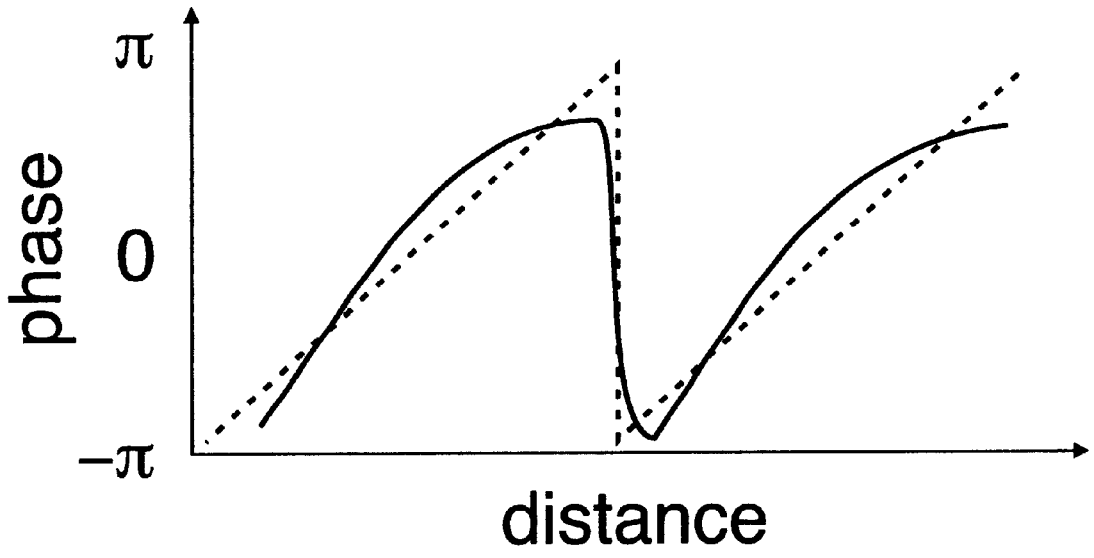
FIG. 15 is a graph of phase discontinuities which can occur with movement or rotation of the one of the board relative to the other board.

The patterns shown for this experiment exhibit scattering at other angles. This is because rotation of the upper board of the experimental structure does not produce a perfectly linear phase function, as dictated by the functional dependence of the resonance frequency on the displacement of the capacitor plates. The problem is most severe at the phase discontinuities, as shown in FIG. 15. With more accurate control over the resonance frequency of each individual cavity, the pattern could be improved.

Figure 16:
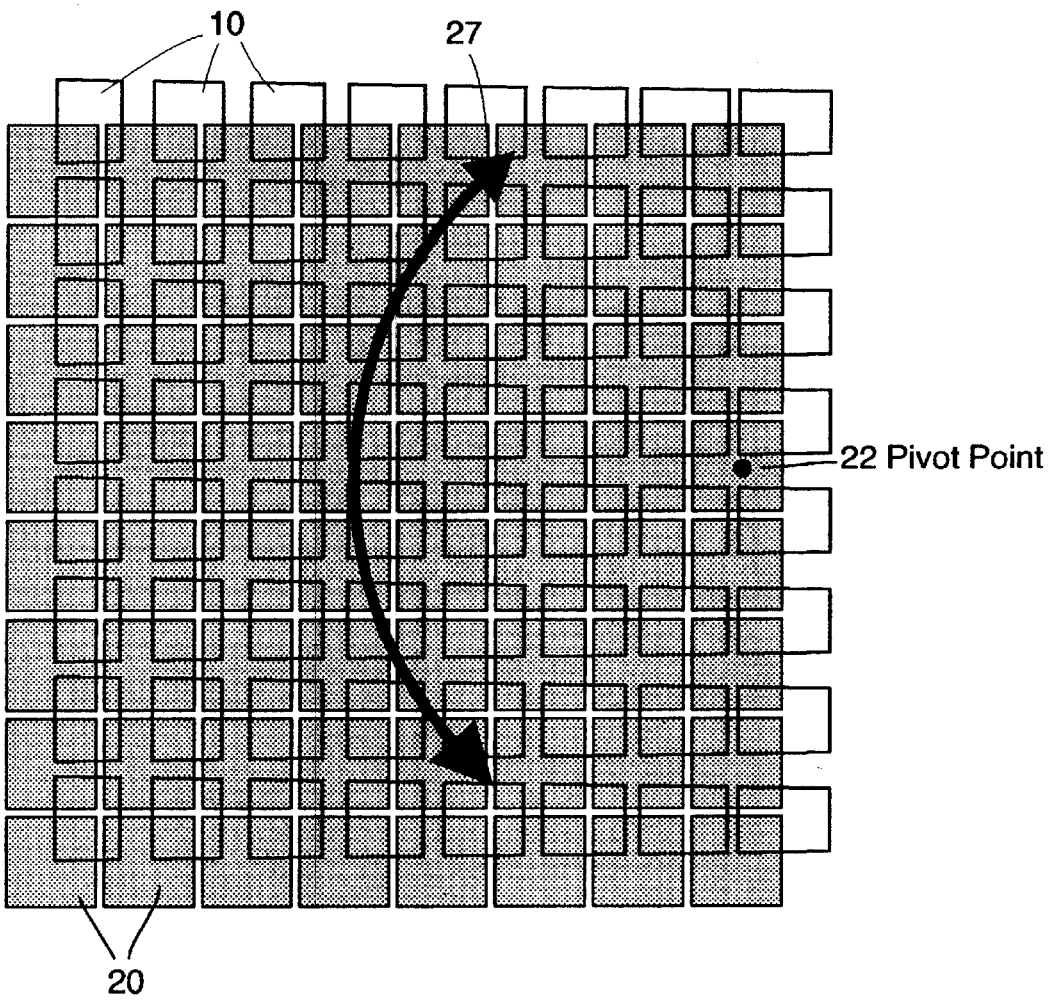
FIG. 16 depicts two boards, one with conductive patches of a uniform size and arrangement and the other of a uniform size but a non-uniform arrangement.

While the phase function produced by this rotational motion tends to be nonlinear, it can be close enough to linear to produce a well-formed beam, as seen in the data. Moreover, it may well be possible to compensate for this non-linearity, and one way of doing this could be to adjust the spacing of the cells $C_1$–$C_4$ formed by plates 10, 20. Another approach would be to adjust the size of the cells $C_1$–$C_4$, while keeping the spacing of the plates uniform. The main objective of this approach would be to provide a surface in which the capacitance is decreased more slowly near the edge on which it is being decreased the most—in other words, to cancel the non-linearity of the phase function. One example of a structure that could do this is shown by FIG. 16. The plates 20 are made longer and narrower on one side, but shorter and wider on the other side. The total capacitance is the same, and but the side with the longer and narrower squares will be slightly less sensitive to translation in the vertical direction. Rotation, as represented by arrow 27, around pivot point 25 should produce a more linear phase function than a uniform lattice would produce. This technique could be used to make any other phase function desired.

In the embodiments shown by the drawings the tunable impedance surface is depicted as being planar. However, the invention is not limited to planar tunable impedance surfaces. Indeed, those skilled in the art will appreciate the fact that the printed circuit board technology preferably used to provide substrates 16, 18 for the tunable impedance surface can provide a very flexible substrate. Thus, the tunable impedance surface can be mounted on any convenient surface and conform to the shape of that surface. However, a planar configuration is preferred since that should make it easier to move board 18 relative to board 16 when the surface it tuned. However other shapes of surfaces can easily slide one relative to another, such as spherical surfaces having slightly different diameters.

The top plate elements 10 and the ground or back plane element 12 are preferably formed from a metal such as copper or a copper alloy conveniently used in printed circuit board technologies. However, non-metallic, conductive materials may be used instead of metals for the top plate elements 10 and/or the ground or back plane element 12, if desired. This is also true for plates 20 formed on board 18. The use of conductors 14 to connect the patches 10, 20 on the two plates 16, 18 is optional, particularly if the RF waves impinging the surface do so at a relatively high angle of incidence. The use of conductors 14 is preferable if the RF waves impinging the surface do so at a relatively low angle of incidence.

Having described the invention in connection with certain embodiments thereof, modification will now certainly suggest itself to those skilled in the art. As such, the invention is not to be limited to the disclosed embodiments except as required by the appended claims.

What is claimed is:

1. A tuneable impedance surface for reflecting a radio frequency beam, the tunable surface comprising:

(a) a ground plane;

(b) a first plurality of elements disposed in an array a first distance from the ground plane, the distance being less than a wavelength of the radio frequency beam; and (c) a second plurality of elements disposed in an array a-second distance from the ground plane, the second plurality of elements being moveable relative to the first plurality of elements.

2. The tuneable impedance surface of claim 1 further including a first substrate having first and second major surfaces, said substrate supporting said ground plane on the first major surface thereof and supporting said first plurality of elements on the second major surface thereof.

3. The tuneable impedance surface of claim 1 further including a second substrate having first and second major surfaces, said substrate supporting said second plurality of elements on the second major surface thereof.

4. The tuneable impedance surface of claim 3 wherein each element of the first and second pluralities of elements has an outside dimension which is less than the wavelength of the radio frequency beam.

5. The tuneable impedance surface of claim 1 wherein the first plurality of elements is coupled to the ground plane by electrically conductive vias in a substrate supporting said ground plane and said first plurality of elements.

6. The tuneable impedance surface of claim 1 wherein the first plurality of elements is arranged in a planar array.

7. The tuneable impedance surface of claim 1 wherein the second plurality of elements is arranged in a planar array.

8. The tuneable impedance surface of claim 1 wherein the first plurality of elements and the second plurality of elements are separated by a dielectric layer.

9. The tuneable impedance surface of claim 8 wherein the first plurality of elements and the second plurality of elements abut said dielectric layer.

10. The tuneable impedance surface of claim 8 wherein the first plurality of elements is fixed relative to said dielectric layer and the second plurality of elements is moveable relative to said dielectric layer.

11. The tunable tunable impedance surface of claim 1 wherein the first plurality of elements are disposed in a two dimensional array, wherein each of the first plurality of elements are spaced from one another, wherein the second plurality of elements are disposed in a two dimensional array, wherein each of the second plurality of elements are spaced from one another and wherein the second plurality of elements are disposed between the first plurality of elements and the ground plane.

12. A method of tuning a high impedance surface for reflecting a radio frequency signal comprising:

arranging a first plurality of spaced-apart conductive surfaces in an array disposed essentially parallel to and spaced from a conductive back plane, arranging a second plurality of spaced-apart conductive surfaces in an array disposed essentially parallel to and spaced from said conductive back plane by a distance greater than the distance said first plurality of spaced-apart conductive surfaces is spaced from said conductive back plane, and moving the second plurality of spaced-apart conductive surfaces relative to the first plurality of spaced-apart conductive surfaces.

13. The method of claim 12 wherein said pluralities of spaced-apart conductive surfaces are arranged on a printed circuit board.

14. The method of claim 12 wherein the step of moving the second plurality of spaced-apart conductive surfaces relative to the first plurality of spaced-apart conductive, surfaces comprises rotational movement in a plane essentially parallel to said arrays.

15. The method of claim 12 wherein the size of each conductive surface along a major axis thereof is less than a wavelength of the radio frequency signal, and preferably less than one tenth of a wavelength of the radio frequency signal, and the spacing of each conductive surface of the first plurality from the back plane is less than a wavelength of the radio frequency signal.

16. The method of claim 12 wherein the high impedance surface is tuned so that a generally linear reflection phase function is impressed on the high impedance surface.

17. The method of claim 16 wherein the linear phase function has discontinuities of $2\pi$ therein.

18. The method of claim 12 wherein the conductive surfaces are generally planar and wherein the array is generally planar.

19. The method of claim 12 wherein the conductive surfaces are metallic and wherein the conductive back plane is metallic.

20. The method of claim 12 wherein the size of each conductive surface along a major axis thereof is less than one tenth of a wavelength of the radio frequency signal and the spacing of each conductive surface of the first plurality from the back plane is less than a wavelength of the radio frequency signal.

21. A tuneable impedance surface for reflecting a radio frequency beam, the tunable surface comprising:

(a) a first substrate formed of a dielectric material having a thickness which is less than a wavelength of the radio frequency beam;

(b) a conductive plane disposed on a major surface of said first substrate;

(c) a first plurality of conductive elements disposed in an array on another major surface of said first substrate, wherein each element of the first plurality of elements has an outside dimension which is less than the wavelength of the radio frequency beam;

(d) a second substrate disposed (i) in a confronting relationship to said first substrate and (ii) relatively moveable to said first substrate; and (e) a second plurality of conductive elements disposed in an array on said second substrate wherein each element of the second plurality of elements has an outside dimension which is less than the wavelength of the radio frequency beam.

22. The tuneable impedance surface of claim 21 wherein the first plurality of elements are coupled to the conductive plane by electrically conductive vias arranged in said first substrate.

23. A tuneable impedance surface for reflecting a radio frequency beam impinging the tuneable impedance surface, the tunable surface comprising:

(a) a ground plane;

(b) a first plurality of elements disposed in a two dimensional array a first distance from the ground plane, the distance being less than a wavelength of the radio frequency beam; and (c) a second plurality of elements disposed in a two dimensional array a second distance from the ground plane, the second plurality of elements being disposed adjacent to and moveable relative to the first plurality of elements for changing a direction by which the radio frequency signal reflects from the high impedance surface.

24. The tunable tunable impedance surface of claim 23 wherein each of the first plurality of elements are spaced from one another, wherein each of the second plurality of elements are spaced from one another and wherein the second plurality of elements are disposed between the first plurality of elements and the ground plane.

25. The tunable tunable impedance surface of claim 24 wherein the first plurality of elements are arranged on a first substrate, wherein the first plurality of elements are ohmically isolated from one another on the first substrate, wherein the second plurality of elements are arranged on a second substrate, and wherein the second plurality of elements are ohmically isolated from one another on the second substrate.

26. A method of tuning a high impedance surface for reflecting a radio frequency signal impinging the high impedance surface, comprising:

arranging a first plurality of spaced-apart, isolated conductive surfaces in a two dimensional array disposed essentially parallel to and spaced from a conductive back plane, arranging a second plurality of spaced-apart, isolated conductive surfaces in a two dimensional array disposed essentially parallel to and spaced from said conductive back plane by a distance greater than the distance said first plurality of spaced-apart conductive surfaces is spaced from said conductive back plane, and moving the second plurality of spaced-apart conductive surfaces relative to the first plurality of spaced-apart conductive surfaces in order to change a direction by which the radio frequency signal reflects from the high impedance surface.

* * * * *